United States Patent [19]

Sardelli

[11] Patent Number: 4,580,417

[45] Date of Patent: Apr. 8, 1986

[54] COACTING GROOVED EARRING POST AND SERRATED CLUTCH

[75] Inventor: Vincent T. Sardelli, Warwick, R.I.

[73] Assignee: T. Sardelli & Sons, Inc., Providence, R.I.

[21] Appl. No.: 642,188

[22] Filed: Aug. 20, 1984

[51] Int. Cl.[4] ..... A44C 7/00; A44B 21/00

[52] U.S. Cl. ..... 63/12; 24/155 BB

[58] Field of Search ..... 63/12, 13; 24/155 BB, 24/581

[56] References Cited

U.S. PATENT DOCUMENTS

| | | | |
|---|---|---|---|
| 320,991 | 6/1885 | Westcott | 63/12 UX |
| 1,423,402 | 7/1922 | Darling | 24/155 BB |
| 3,040,406 | 6/1962 | Artzt | 24/155 BB |
| 4,307,582 | 12/1981 | Mancini | 63/12 |
| 4,397,067 | 8/1983 | Rapseik | 63/12 X |

*Primary Examiner*—F. Barry Shay

*Attorney, Agent, or Firm*—Salter & Michaelson

[57] ABSTRACT

A clutch and post for pierced earrings is operative for retaining an earring on an earlobe of a wearer with increased effectiveness. The clutch comprises a base portion having an aperture therethrough for receiving the post, and a pair of rearwardly and inwardly curled resilient leaves which extend from the base portion and have serrations thereon. The serrations are transversely disposed on the leaves, and they are preferably arranged so that they define longitudinally extending ribs of adjacent serrations on the leaves. This structure strengthens the leaves and enables using a metal thickness up to 30% less than that of a similar clutch without the ribs. The post comprises an elongated substantially cylindrical member having a plurality of substantially circumferential grooves therein and it is receivable through the aperture in the base portion of the clutch and between the resilient leaves thereof so that the serrations of the leaves interengage the grooves to more securely retain the clutch on the post.

1 Claim, 3 Drawing Figures

COACTING GROOVED EARRING POST AND SERRATED CLUTCH

BACKGROUND AND SUMMARY OF THE INVENTION

The instant invention relates to earrings, and more particularly, to a clutch and post for pierced earrings, wherein the clutch is effectively retained on the post to retain an earring on an ear of a wearer to prevent inadvertent loss of the earring.

Most of the pierced earrings currently available are of a type which comprises an elongated substantially straight cylindrical post which is receivable through an aperture in an earlobe of a wearer, and a clutch which is receivable on the post on the rear side of the earlobe so that it frictionally embraces the post and thereby retains the earring on the earlobe. The most common clutch construction for pierced earrings of this general type comprises a base portion having an aperture therethrough and a pair of curled resilient leaves which converge and meet in substantially face-to-face relation along the axis defined by the aperture. When a clutch of this type is received on an earring post, the resilient leaves embrace the post where it passes therebetween and accordingly the leaves cooperate to frictionally retain the clutch on the post. However, it has been found that a clutch and post arrangement of this type can be less than entirely satisfactory for securing an earring on an ear of a wearer and that in many instances clutches of this type have become dislodged from the ends of posts and this has resulted in the loss of the earrings. Obviously this presents a more serious problem with expensive earrings, such as earrings bearing precious gems or the like, although it is really a problem with a wide range of the heretofore available pierced earrings. In order to overcome this problem, a variety of other types of pierced earring post and clutch constructions have been developed to securely retain pierced earrings on the ears of wearers. The devices disclosed in the U.S. Pat. Nos. to Artzt 3,040,406, Masters 3,630,048, Tucker 4,139,993, Green 4,184,343, Block 4,245,484, Block 4,236,385, Mancini 4,307,582, Evans 4,353,370, McDonald et al 4,382,317, and Rapseik 4,397,067 are exemplary of other types of posts and clutches which are adapted for use in earring constructions and represent the closest prior art to the instant invention of which the applicant is aware. However, these devices have also not been entirely effective for retaining earrings on the ears of wearers and some of them are relatively expensive to manufacture because of high material costs, particularly when they have been constructed of precious metals. In this regard, since most earring clutches and posts are required by law to be either constructed from, or at least plated with, precious metals in order to minimize the risks of infection to the wearer's ear, material costs are normally a primary concern. In any event, none of the above patents teach the novel features of the earring clutch and post of the instant invention and hence they are believed to be of only general interest with respect thereto.

The instant invention provides a pierced earring clutch and post which are operative for effectively retaining a pierced earring on an earlobe of a wearer but which can be manufactured relatively inexpensively and hence the clutch and post of the instant invention have substantial advantages over other heretofore known post and clutch constructions. Specifically, the clutch of the instant invention comprises a base portion having an aperture therethrough and a pair of curled resilient leaves which extend from the base portion and converge so that they substantially meet in face-to-face relation along the axis defined by the aperture. The leaves are, however, formed with serrations thereon which are engageable with an earring post received through the aperture and between the leaves so that the serrations are operative for retaining the clutch on the post with enhanced effectiveness. Preferably the serrations are embodied as serrated ribs which are centrally disposed on the leaves and co-extend with the leaves from the base portion to the terminal ends of the leaves. It has been found that when the clutch of the instant invention is constructed in this manner the serrations of the ribs are operative for effectively grasping a post when it has been received in engagement therebetween to retain the clutch on the post, and the ribs also function to strengthen the leaves. In fact, it has been found that when the clutch is formed with serrated ribs on the leaves, the entire clutch can actually be constructed from a metal having a slightly reduced thickness and this feature is particularly significant when the clutch is constructed of a precious metal. Preferably the clutch is used in combination with a pierced earring post having a plurality of substantially circumferential grooves therein which are interengageable with the serrations on the clutch so that the grooves and the serrations cooperate to further retain the clutch on the post. When the clutch and post of the instant invention are embodied in this manner, they can be relied upon to effectively retain an earring on an earlobe of a wearer and because of their high degree of reliability they can be utilized with even highly expensive earrings.

Accordingly, it is an object of the instant invention to provide an effective post and clutch for a pierced earring.

Another object of the instant invention is to provide an earring clutch having serrations thereon and a post having circumferential grooves therein, wherein the serrations on the clutch are engageable with the grooves in the post to effectively retain the clutch on the post.

A still further object of the instant invention is to provide an earring clutch having serrated ribs which are engageable with a post to retain the clutch on the post and which also add strength to the clutch.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
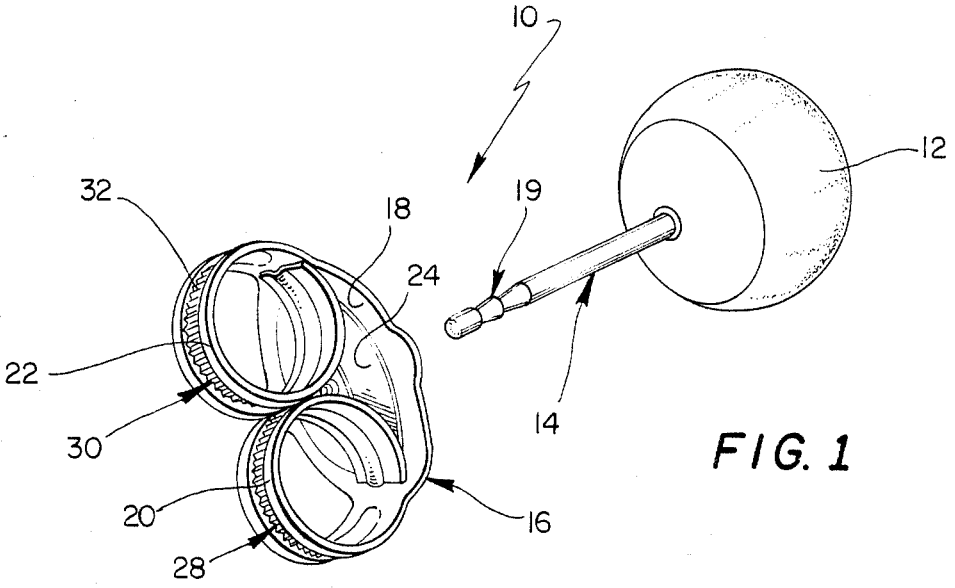
FIG. 1 is an exploded perspective view of an earring embodying the post and clutch of the instant invention.

Referring now to the drawing, a pierced earring embodying the post and clutch of the instant invention is illustrated and generally indicated at 10 in FIG. 1. The earring 10 comprises a conventional ornamental portion 12, a post generally indicated at 14 which is attached to the ornamental portion 12, and a clutch generally indicated at 16 which is receivable on the post 14. The earring 10 is adapted to be worn in a conventional manner, wherein the post 14 extends through an aperture in an earlobe of a wearer so that the ornamental portion 12 is positioned on the front side of the lobe and the clutch 16 is positioned on the rear side of the lobe and received on the post 14, whereby the earlobe is captured between the clutch 16 and the ornamental portion 12 and the earring 10 is retained on the earlobe.

Figure 2:
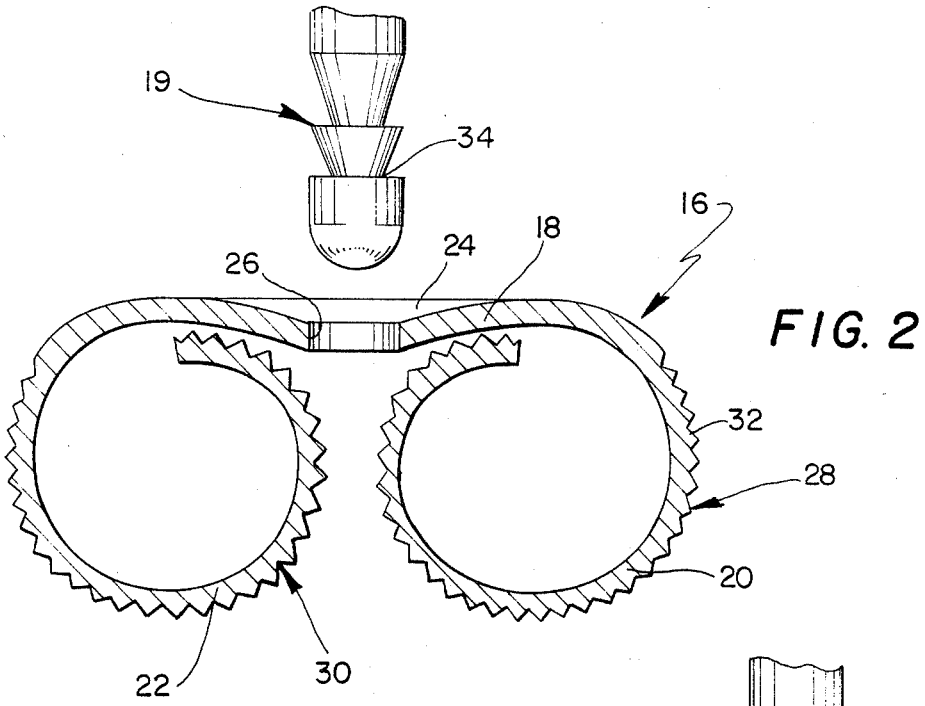
FIG. 2 is an enlarged fragmentary side elevational view of the post and clutch portions of the earring.
Figure 3:
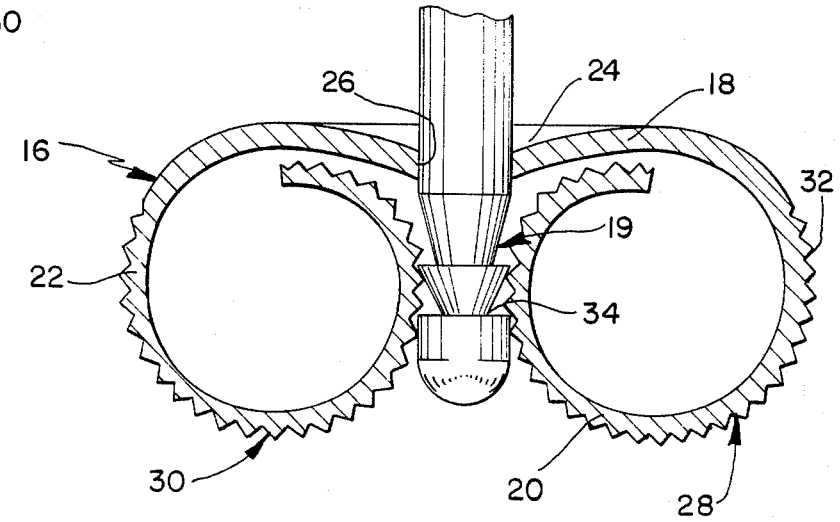
FIG. 3 is a similar view with the post received in the clutch.

The clutch 16 is preferably integrally formed in a stamping and forming operation from a suitable sheet metal having the requisite resiliency and comprises a base portion 18 which is preferably of a generally oval-shaped configuration, and first and second curled leaves 20 and 22 which extend rearwardly and inwardly from opposite extremities of the base portion 18 and hence are located on the rear side of the clutch 16. The base portion 18 has a rearwardly recessed central portion 24 and a substantially central aperture 26 extends through the central portion 24. The leaves 20 and 22 are formed in curled configurations and they converge so that when the clutch 16 is disassembled from the post 14, they substantially meet in face-to-face relation, i.e., they are spaced from each other a distance less than the diameter of post 14, as illustrated in FIG. 2. The leaves 20 and 22 are formed so that they are resiliently biased together and they are resiliently separable to receive the post 14 therebetween. Accordingly, when the clutch 16 is received on the post 14 the leaves 20 and 22 resiliently embrace the post 14 to retain the clutch 16 thereon.

Formed on the leaves 20 and 22 are serrated ribs 28 and 30, respectively, which co-extend along the central portions of the leaves 20 and 22 from the base portion 18 to the terminal ends of the leaves 20 and 22. The ribs 28 and 30 each comprise a plurality of serrations 32 which are preferably substantially transversely disposed with respect to the longitudinal extents of the respective ribs 28 and 30. The ribs 28 and 30 are postioned on the leaves 20 and 22 so that at least the substantially face-to-face portions of the pluralities of serrations are substantially parallel with the axis defined by the aperture 26, and hence when the clutch 16 is received on the post 14 the serrations 32 engage the post 14 to provide enhanced retention of the clutch 16 on the post 14. Further, it has been found that when the leaves 20 and 22 are formed with the ribs 28 and 30 in the manner herein set forth, the ribs 28 and 30 also function to strengthen the leaves 20 and 22. As a result of this phenomenon, the entire clutch 16 can be constructed with a reduced metal thickness which provides substantial economic benefits, particularly when the clutch 16 is constructed of a precious metal. Specifically, it has been found that a clutch which includes the ribs 28 and 30, requires a metal thickness which is approximately 30% less than a similar clutch which does not include the ribs 28 and 30. For example, it has been found that a clutch constructed without the ribs 28 and 30 which requires a metal having a thickness of 0.007 inches can be constructed from the same metal with a thickness of 0.005 inches when it includes the ribs 28 and 30. Hence when the clutch of the instant invention is constructed of a precious metal, substantial economic benefits are also realized.

The post 14 comprises an elongated substantially cylindrical member which is dimensioned to be received through the aperture 26 and it is preferably formed with a plurality of substantially circumferential grooves 34 therein adjacent the free end thereof. As a result, the post 14 is interengageable with the serrations 32 of the serrated ribs 28 and 30 when the clutch 16 is received on the post 14. Specifically, when the post 14 is inserted through the aperture 26, the terminal portion of the post 14 initially engages the leaves 20 and 22 to urge them apart. As the post 14 is further inserted through the aperture 26 the serrations 32 interengage the post 14 in the grooves 34 so that an enhanced grasping of the post 14 by the leaves 20 and 22 is achieved. In this regard, the post 14 can easily be inserted between the leaves 20 and 22 despite the presence of the serrated ribs 28 and 30 since the leaves 20 and 22 are resiliently separable, but when an attempt is made to remove the post 14 from between the leaves 20 and 22, the interengagement of the serrations 32 with the post 14 in the grooves 34 causes the leaves 20 and 22 to be curled more tightly so that they grasp the post 14 even more firmly. The clutch 16 can, however, be removed from the post 14 when desired by applying a force to the clutch 16 which is sufficient to overcome these grasping forces. Further, by providing a plurality of grooves 34, as illustrated, the position of the clutch 16 on post 14 may be adjusted to comfortably accomodate different thickness earlobes.

It is seen therefore that the instant invention provides an effective clutch and an effective clutch and post combination for pierced earrings. The serrated ribs 28 and 30 provide enhanced grasping of the post 14, particularly when the post 14 is formed with the grooves 34. The ribs 28 and 30 also add strength and rigidity to the clutch 16 and this allows it to be made of a lighter guage metal. The clutch and post of the instant invention are operative for effectively retaining the earring 10 on an ear of a wearer and for substantially reducing the risk of losing the earring 10 because of the firm embracing engagement of the post 14 by the clutch 16. Accordingly for these reasons, as well as other reasons hereinabove set forth, it is seen that the instant invention represents a significant advancement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clutch and post combination for pierced earrings comprising a clutch comprising a base portion having an aperture therethrough and a pair of inwardly curled resilient leaves which extend from said base portion and are biased to a postion wherein they substantially meet in face-to-face relation along the axis defined by said aperture, said leaves each having a plurality of serrations thereon, and an earring post detachably received first through said aperture and then in embracing engagement between said leaves, said post having a plurality of substantially annular grooves therein, said serrations interengaging said post in said grooves and cooperating with said grooves so that said grooves and serrations coact as means to retain said clutch on said post by causing said leaves to be resiliently curled inwardly to an increased extent so that they further embrace said post when a withdrawing force is applied to said post.

* * * * *